US006851570B2

(12) United States Patent
Janssen

(10) Patent No.: US 6,851,570 B2
(45) Date of Patent: Feb. 8, 2005

(54) PAINT TRAYS

(76) Inventor: Robert Ives Janssen, 1160 Sibley Memorial Hwy., Mendota Heights, MN (US) 55118

( * ) Notice: Subject to any disclaimer, the term of this patent is extended or adjusted under 35 U.S.C. 154(b) by 273 days.

(21) Appl. No.: 09/798,664

(22) Filed: Mar. 2, 2001

(65) Prior Publication Data

US 2002/0121523 A1 Sep. 5, 2002

(51) Int. Cl.[7] ..... B05C 21/00
(52) U.S. Cl. ..... 220/570; 220/495.02
(58) Field of Search ..... 220/570, 23.88, 220/23.83, 495.02

(56) References Cited

U.S. PATENT DOCUMENTS 606,100 A * 6/1898 Thompson ..... 220/23.88
2,646,808 A * 7/1953 Yenne ..... 134/104.4
5,111,958 A * 5/1992 Witthoeft ..... 220/23.83
5,417,338 A * 5/1995 Roy et al. ..... 220/23.4
5,553,701 A * 9/1996 Jarecki et al. ..... 15/257.06
5,966,772 A * 10/1999 Woodnorth et al. ..... 118/258
6,434,782 B2 * 8/2002 Wakat et al. ..... 220/570

* cited by examiner

*Primary Examiner*—Joseph Man-Fu Moy
(74) *Attorney, Agent, or Firm*—Jacobson & Johnson

(57) ABSTRACT

Briefly, the present invention is a paint tray assembly comprising a multi-use paint tray having a trough located therein and at least one removable paint containers retained in a lateral fit within the trough of the paint tray with the removable paint container being separately removable from the trough of the paint tray to allow for individual emptying of paint compartments in the paint tray.

14 Claims, 4 Drawing Sheets

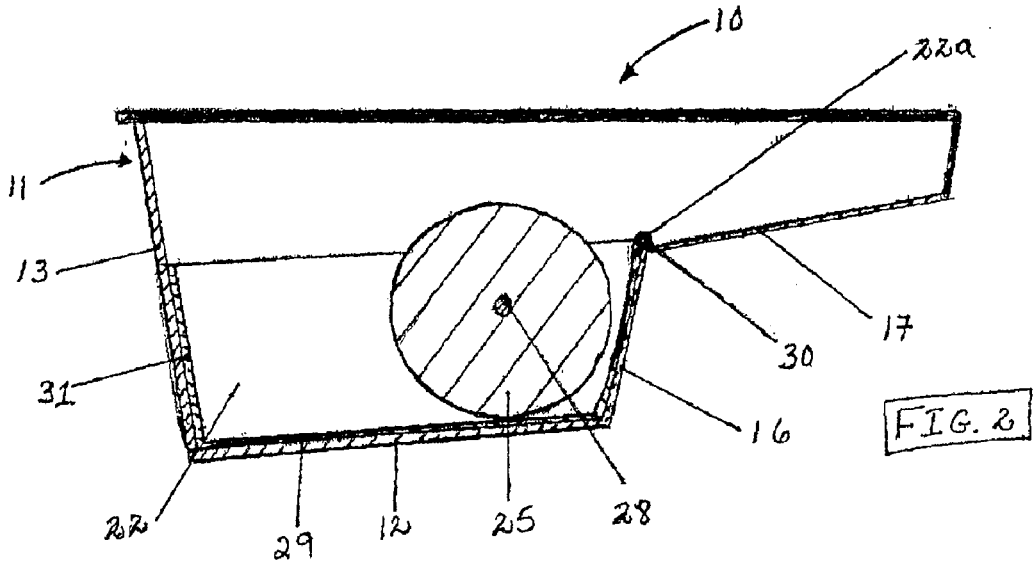
FIG. 2
FIG. 3
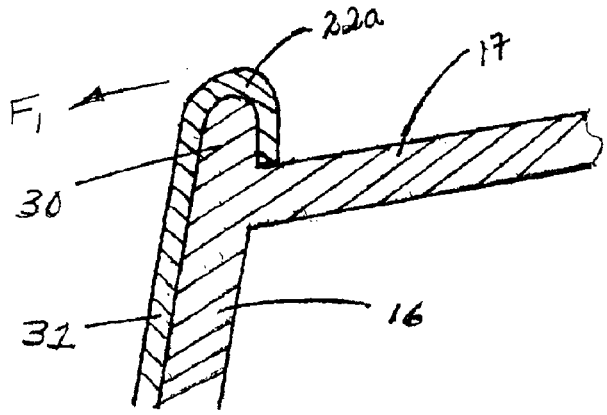

PAINT TRAYS

FIELD OF THE INVENTION

This invention relates generally to paint trays and more specifically to a multiple use paint tray assembly for holding one or more removable paint containers.

BACKGROUND OF THE INVENTION

In my U.S. copending patent application Ser. No. 09/258,219 titled Paint System filed Feb. 26, 1999, which is incorporated herein by reference, I describes a method of insitu blending different color paints using a paint pad applicator in conjunction with a paint tray that has multiple individual paint compartments. Each of the paint tray compartments holds a different color paint. For example, one compartment can hold blue paint, another compartment can hold red paint and still another compartment can hold white paint. Also, if desired, some of the paint compartments can hold paint of the same color. In order to change the insitu blending one needs to change the color of the paint in one or more of the paint compartments. As certain colors are additive one can change the color of paint in a paint compartment by adding a paint of another color, which is usually done by trial and error. To eliminate trial and error mixing one could empty the paint compartment and refill the compartment with fresh paint of the desired color. However, if a paint tray has multiple compartments it is difficult to empty only one of the compartments as the paints from the other compartments are likely to mix with each other as the user tries to pour the paint from the paint tray back into a paint container. Also a user may want to use only a single paint container rather than multiple paint containers.

The present invention comprises a paint tray assembly which allows a painter to apply paint from one paint container and if multiple removable paint containers are used to empty the paint in one of the removable paint containers without having to empty the paint in all the rest of the paint containers. This allows a user to change the insitu blending without having to add paint to a container through a process of trial and error.

SUMMARY OF INVENTION

The present invention is a paint tray assembly comprising a paint tray having a trough and a plurality of paint containers located therein with at least one of the paint containers removable. The removable paint container has a retaining member for preventing the accidental displacement of the removable paint container and a first axle housing and a second axle housing for supporting an axle of a paint applicator roller. The paint containers each are laterally positioned to form a side-by-side fit within the trough of the paint tray allowing for the retaining member to engage the paint tray to prevent the accidental displacement of the removable paint container when paint is being applied to a paint pad. If multiple removable paint containers are used each of the removable paint containers can be removed from the trough of the paint tray without the removal of other removable paint containers.

BRIEF DESCRIPTION OF THE DRAWINGS

FIG. 2 is a cross sectional view of paint tray assembly of FIG. 1 taken along the lines 2—2, showing the second removable paint container held in a paint tray.

FIG. 3 is a blow-up a portion of FIG. 2 showing the engagement between a U-shaped member on the paint container and a protrusion the paint tray

DESCRIPTION OF THE PREFERRED EMBODIMENT

Figure 1:
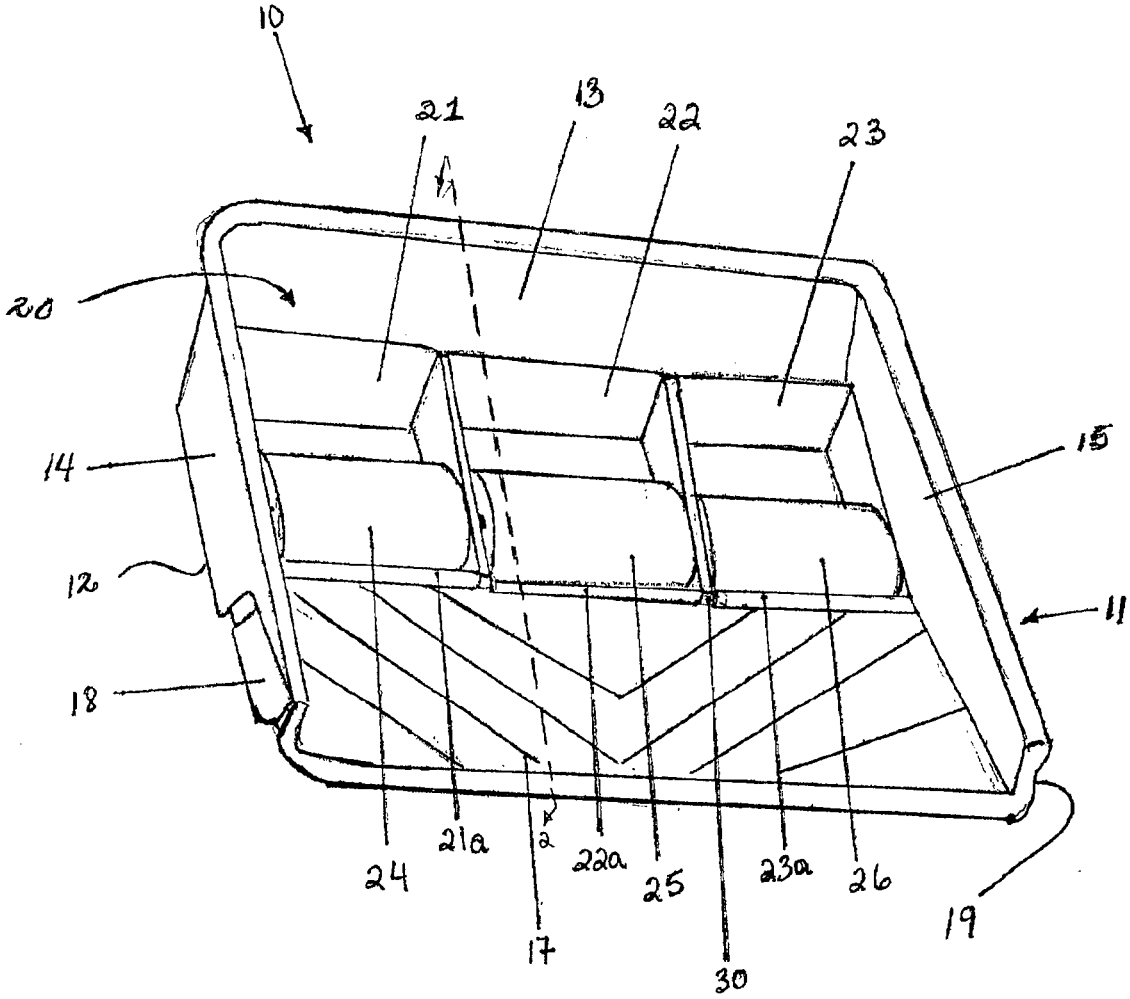
FIG. 1 shows an perspective view of the paint tray assembly of the present invention.

FIG. 1 shows a perspective view of the paint tray assembly 10 of the present invention. Paint tray assembly 10 comprises a paint tray 11; a first removable paint container 21 having a first paint applicator roller 24, a second removable paint container 22 having a second paint applicator roller 25 and a third removable paint container 23 having a third paint applicator roller 26.

Paint tray 11 includes a base 12, a back wall 13, a first side wall 14, a second side wall 15, a skirt 16 (shown in FIG. 2), a ramp 17 and a protrusion 30 located proximate the junction of skirt 16 and ramp 17. A first ramp support 18 supports one side of the paint tray and a second ramp support 19 supports the other side of the paint tray to hold the paint tray in an upright condition. Paint tray 11 also includes a paint trough 20 defined by base 12, back wall 13, skirt 16 (shown in FIG. 2), first side wall 14 and second side wall 15. In the embodiment shown three paint containers are shown in a side by side condition in paint trough 20. In this condition the paint tray can be used for insitu blending of different color paints. A feature of the present invention is that if the user decides that only one color paint is to be applied as opposed to blending of different color paints the user can remove the individual paint containers 21, 22 and 23 which allows the paint tray 11 to be used as a conventional one compartment paint tray.

FIG. 1 shows paint trough 20 having a first removable paint container 21 having a U-shaped retaining member 21*a*, a second removable paint container 22 having a U-shaped retaining member 22*a*, and a third removable paint container 23 having a U-shaped retaining member 23*a*. The removable containers are used for holding paints, preferable of different colors for use in tasks which requires the use of various paint color combinations in order to obtain insitu blending. As shown, located within first removable paint container 21 is a first paint applicator roller 24 that is rotatably supported in paint container 21. Similarly, a second paint applicator roller 25 is rotatably supported in paint container 22 and a third paint applicator roller 26 is rotatably supported in paint container 23. The paint applicator rollers are used for transferring paint from the respective paint containers to a portion of a paint pad. The transfer of paint from the paint containers to the paint pad is done by the rotation of the rollers. As each of the rollers rotate they absorb paint from their respective removable paint containers and transfer the paint to the section or area of the paint pad that they engage.

Figure 4:
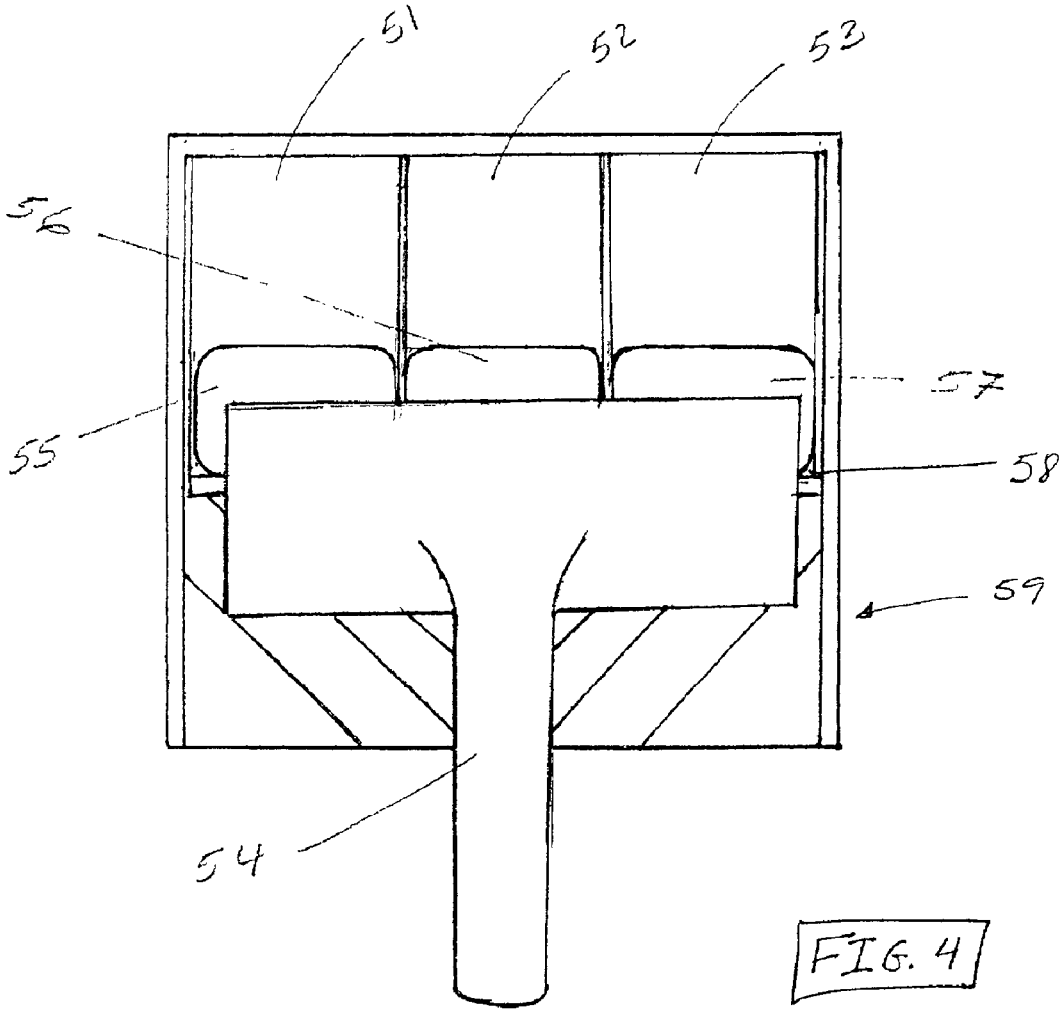
FIG. 4 is a top view showing the transfer of paint from the removable paint containers to a paint pad by the rotation of paint roller applicators.

FIG. 4 is a top view showing the transfer of paint to a paint pad 54 from a first removable paint container 51 by the rotation of a first paint roller applicator 55. Similarly, a second removable paint container 52 having a second paint roller applicator 56 and a third removable paint container 53 having a third paint roller applicator 57 transfer paint to a paint pad 54. As shown, removable paint container 51, 52, 53 are located in a side-by-side relationship within a trough 58 of a paint tray 59. As the paint roller applicators rotate, the roller applicators absorb paint from the respective containers and carry the paint upward to where the paint is transferred to the paint pad from the roller applicator.

FIG. 2 is a cross sectional view of paint tray assembly 10 of FIG. 1 taken along the lines 2—2 of FIG. 1 showing the engagement of the second removable paint container 22 with paint tray 11 while second removable paint container 22 holds second paint applicator roller 25. As shown, a base 29 of second removable paint container 22 engages the base 12 of paint tray 11 while a vertical extending wall 31 of second removable paint container 22 engages the back wall 13 and the skirt 16 of paint tray 11 to hold the paint container in a snug condition to prevent the removable paint containers from moving from side to side. Although located in a snug condition the paint containers are sufficiently spaced laterally so as to allow for removable of an individual paint container without having to remove an adjacent paint container.

Located within second removable paint container 22 is second paint applicator roller 25. Second paint applicator roller 25 is rotatably supported in place within removable paint container 22 by the engagement of an axle 28, protruding from opposite ends of second paint applicator roller 25. The axle 28 can engage axle housings such as axle housings 45 and 46 (shown in FIG. 5) or axle housing 38 and 39 (shown in FIG. 6) of second removable paint container 22. As was previously mentioned, the transfer of paint from the paint containers to the paint pad is accomplished by the rotation of roller 25. As roller 25 rotates roller 25 absorbs paint from removable paint container 22 and transfers the paint to the section or area of the paint pad where roller 25 engages the paint pad.

FIG. 2 shows a retaining member 22*a* of second removable paint container 22 engaging a protrusion 30 of paint tray 11 to hold paint container in position. A blow-up of the engagement between retaining member 22*a* and vertical protrusion 30 of tray 11 is shown in FIG. 3. illustrating that retaining member 22*a* comprises a U-shaped member that fits snugly over the protrusion to prevent both lateral and downward movement of paint tray 22. As shown in FIG. 2 and FIG. 3, when a force of $F_1$, which likely are forces created during the transfer of paint from the roller 25 to a paint pad, is applied on second removable paint container 22 the engagement of U-shaped retaining member 22*a* to protrusion 30 prevents the rocking or displacement of second removable paint container 22 with respect to paint tray 11. In addition, the retaining members provide a gripping region to allow a user to grasp an individual container and lift the container free of the paint tray.

Figure 5:
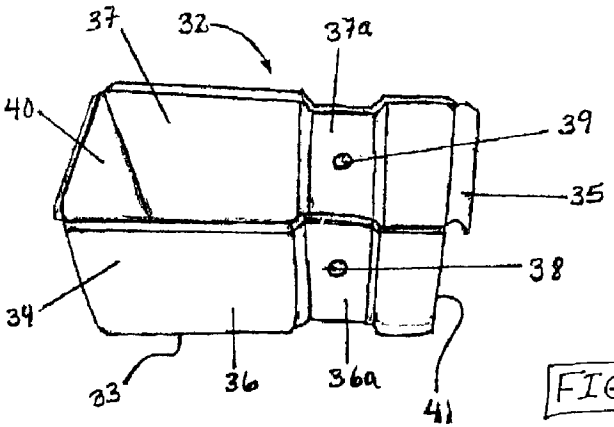
FIG. 5 is a perspective view showing an embodiment of a removable paint container.

FIG. 5 is a perspective view showing an embodiment of a removable paint container 32. Removable paint container 32 includes a base 33 having outer edges and a vertically extending wall 34 connected to the outer edges of base 33 which defines a first side wall 36, a second side wall 37, a back wall 40 and front wall 41. Securely attached to front wall 41 is a U-shaped retaining member 35 for engaging protrusion 30 (shown in FIGS. 1–3) of the paint tray 10.

Located on first side wall 36 of removable paint container 32 is a first indented wall 36*a* having a first axle housing 38 located therein for supporting a paint applicator roller axle. Located on the second side wall 37 of removable paint container 32 is a second indented wall 37*a* having a second axle housing 39 located therein for supporting a paint applicator roller axle. A feature of the axle housings are that the paint applicator roller axles that are housed within the axle housings are allowed to rotate within the axle housings which in turn allows the paint applicator rollers to rotate and transfer paint to the paint pad.

The use of the removable paint container 42 allows a user to quickly use and change several different paint colors while retaining the reusability of the various paints. A user can have a plethora of removable paint containers each holding a different color paint. The user than would place the removable paint container with the desired paint combinations within the trough of the paint tray 11. When a new paint combination is desire, the user would then remove the removable paint container holding the paint that the user will not be using. The unused paint from that container can then be set aside for later use or else can be poured back into a paint can. Once the paint task has been completed the user can pour all of the paint back to the original containers and clean or dispose of the removable paint containers. This can result in reduced paint cost and less of a mess for the user to clean up.

Figure 6:
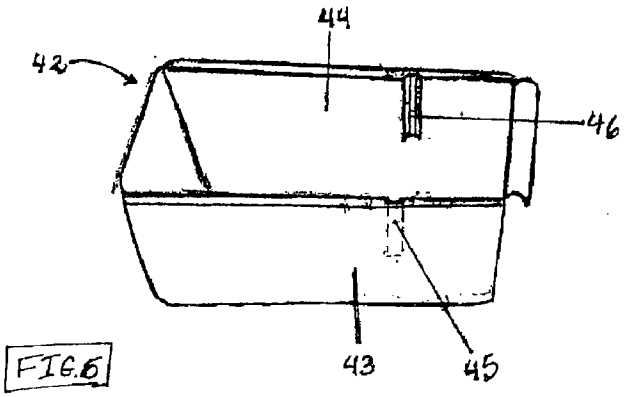
FIG. 6 is a perspective view showing an alternative embodiment of a removable paint container.

FIG. 6 is a perspective view showing an alternative embodiment of a removable paint container 42. As shown, the first wall 43 and the second wall 44 of removable paint container 42 does not contain an indented wall as compared to the removable paint container embodiment of FIG. 5. In addition, to support a roller applicator axle, removable paint container 42 has a first U-shape axle housing 45 integral to the first side wall 43 and a second U-shape axle housing 46 integral to the second side wall 44.

Figure 7:
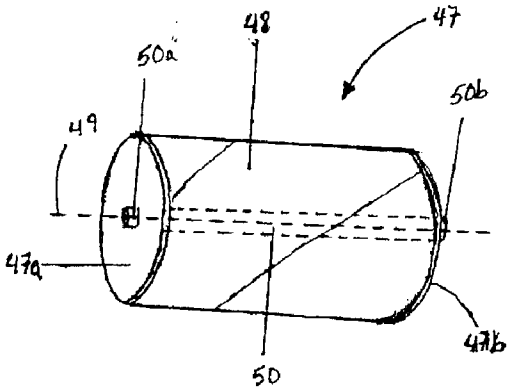
FIG. 7 is a perspective view showing a paint applicator roller used in the present invention.

FIG. 7 is a perspective view showing a paint applicator roller 47 used in the present invention. Paint applicator roller 47 has a cylindrical body having a first end 47*a* and a second end 47*b* with a paint absorbing surface 48 for the transferring of paint from the removable paint container to a painting pad. The paint absorbing surface of each paint applicator roller can differ in their absorption ability depending on the material used in the roller.

Located through the central axis 49 of paint applicator roller 47 is an axle 50 having a first end 50*a* and a second end 50*b* with the first end 50*a* of axle 50 protruding from first end 47*a* of paint applicator roller 47 and second end 50*b* of axle 50 protruding from second end 47*b* of paint applicator roller 47. Protruding ends 50*a* and 50*b* of axle 50 engage the axle housings of a removable paint container to support paint applicator roller 47 within the removable paint container while allowing the ends of axle 50 to rotate within the housing.

The present invention also includes a method of making a paint tray assembly 10 having removable paint carrying containers 22, 23, and 24 comprising: (1) making a paint tray 11 having a ramp 17, a trough 20 and a protrusion 30 located at the junction of ramp 17 and the trough 20; (2) molding a plurality of removable paint containers such as removable paint container 22 having a U-shaped retaining member 22*a*, a first axle housing 38 and a second axle housing 39. The containers are formed so as to be laterally fitable within the trough 20 of the paint tray 11. (3) Inserting the removable paint container 22 and similarly removable paint containers such as paint containers 21 and 23 laterally within the trough 20 of the paint tray 11 with the U-shape retaining member 22*a* of the removable paint container 22 engaging the protrusion 30 of the paint tray 11 in a locking manner. (4) Connecting a paint applicator roller 25 to the removable paint container 22.

While the invention has been shown and described with respect to application of multiple paints to a single paint pad applicator it should be understood that the present invention can also be used to hold and apply multiple paint to a paint roller. In the paint roller mode the individual rotatable paint roller applicators in the removable containers are not needed as the paint roller can be rolled directly in each of the paint roller containers.

In the embodiment shown each of the paint containers located in the paint trough are removable to allow for emptying of the paint therein. If desired, one of the paint containers can be a permanent part of the paint tray. If the paint container is a permanent part of the paint tray the paint located in the permanently mounted paint container can be emptied from the paint tray by temporarily removing the removable paint container and then emptying the permanent paint container. When completed the removable paint container can be replaced with the paint therein and the permanent paint container can be refilled. For example, in the embodiment shown in FIG. 1 any of the removable paint containers could be made into a permanent container by adhesively securing the bottom of the removable container to the base of the paint tray 11. In an alternate embodiment one of the paint containers could be molded directly into the paint tray so as to be a permanent paint container that extended only partway across the paint tray 11.

I claim:

1. A paint tray assembly for loading paint onto a paint pad applicator comprising:

a base, a back wall, a first side wall and a second side wall, and a skirt wherein the base, the back wall, the first side wall, the second side wall, and the skirt define a paint trough;

a ramp, the ramp extending from the skirt of the paint trough;

a first ramp support extending downwardly from the ramp;

a second ramp support extending downwardly from the ramp with the first ramp support and the second ramp support supporting the paint tray assembly in an upright condition;

a protrusion located proximate the ramp and the skirt;

a first removable paint container, the first removable paint container having a U-shaped retaining member engageable in a locking manner with the protrusion; and a second removable point container, the second removable paint container having a U-shaped retaining member engageable with the protrusion in a locking manner, each of the removable paint containers having a first axle housing and a second axle housing, and each of the removable containers having a roller with an axle for engaging the axle housings of the removable paint container so that one can simultaneously apply paint from the first removable paint container and the second removable paint container to a single paint pad applicator.

2. The paint tray assembly of claim 1 wherein each of the rollers have a paint absorbing surface for transferring paint to the paint pad applicator.

3. The paint tray assembly of claim 1 including at least three removable paint containers.

4. The paint tray assembly of claim 1 wherein each of the first axle housings comprises a first integral U-shape axle housing and the each of the second axle housing comprises a second integral U-shape axle housing.

5. The paint tray assembly including:

a paint tray having a trough located therein;

a first removable paint container, the first removable paint container located in the trough of the paint tray; and a second removable paint container, the second removable paint container located in the trough of the paint tray with the first removable paint container and the second removable paint container forming a lateral side-by-side non interfering fit within the trough of the paint tray with each of the removable paint containers being removable without the removal of the other paint container to enable a user to empty either the first removable paint container without emptying the second paint container or vice versa; and a paint applicator roller in each of the paint containers with each of the paint applicator rollers have a paint absorbing surface for transferring paint to a paint pad.

6. The paint assembly of claim 5 including a permanently mounted paint container located in the trough of the paint tray.

7. The paint tray assembly of claim 5 wherein each of the paint containers contains a different color paint.

8. The paint tray assembly of claim 5 wherein the removable paint containers includes a retaining member for engaging the tray.

9. The paint tray assembly of claim 8 wherein each of the paint containers are supported by the paint tray.

10. The paint tray assembly of claim 9 wherein each of the paint containers fit in side-to-side contact with each other to prevent sideways displacement of the paint containers.

11. The paint tray assembly of claim 6 wherein each of the removable paint containers have a retaining member for preventing accidental displacement of the removable paint container in the paint tray.

12. The paint tray assembly including:

a paint tray having a trough located therein;

a first removable paint container, the first removable paint container located in the trough of the paint tray; and a second removable paint container, the second removable paint container located in the trough of the paint tray with the first removable paint container and the second removable paint container forming a lateral side-by-side fit within the trough of the paint tray with each of the removable paint containers being removable without the removal of the other paint container to enable a user to empty either the first removable paint container without emptying the second paint container or vice versa; and a first axle housing on the first removable paint container integral to the first removable paint container and a second axle housing integral to the first removable paint container for rotatably supporting a roller therein.

13. A paint tray assembly comprising:

a paint tray having a trough located therein;

a first removable paint container and a second removable paint container, said removable paint containers each located in the trough of said paint tray, said removable paint containers each having a roller supported therein, said rollers for simultaneously applying paint from the removable paint containers to a single paint pad applicator.

14. The paint tray assembly of claim 13 including a third removable container located in the trough of said paint tray.

* * * * *